United States Patent [19]

Finnimore

[11] 4,030,387

[45] June 21, 1977

[54] SHEET CUTTING MACHINE

[76] Inventor: Norman Alan Finnimore, "Cornerstones" East Hill, Ottery Saint Mary, Devon, England

[22] Filed: May 5, 1975

[21] Appl. No.: 574,688

[30] Foreign Application Priority Data

May 6, 1974 United Kingdom ..... 19900/74

[52] U.S. Cl. ..... 83/49; 83/440.2; 83/447; 83/595; 83/602; 83/607

[51] Int. Cl.[2] ..... B26D 1/26

[58] Field of Search ..... 83/594, 49, 595, 56, 83/916, 917, 602, 605, 607, 440.2, 447

[56] References Cited

UNITED STATES PATENTS

| | | | |
|---|---|---|---|
| 363,524 | 5/1887 | Libbey | 83/605 |
| 547,293 | 10/1895 | Ryan | 83/605 X |
| 1,010,577 | 12/1911 | Bolli et al. | 83/602 X |
| 2,643,720 | 6/1953 | Miles | 83/916 X |
| 2,801,691 | 8/1957 | Glass | 83/605 X |
| 3,134,285 | 5/1964 | Greene | 83/607 X |
| 3,392,615 | 7/1968 | Rosskath | 83/607 X |
| 3,714,856 | 2/1973 | Hall et al. | 83/605 X |

FOREIGN PATENTS OR APPLICATIONS

| | | |
|---|---|---|
| 145,135 | 2/1952 | Australia |
| 273,249 | 2/1967 | Australia |
| 132,489 | 5/1949 | Australia |

*Primary Examiner*—Frank T. Yost
*Attorney, Agent, or Firm*—Larson, Taylor and Hinds

[57] ABSTRACT

In the cutting of asbestos sheet or the like, the sheet is supported on a bed and a cutting blade is advanced through the sheet and through a narrow slot in the bed below the sheet. The cutting edge of the blade has a flat transverse profile so that the sheet is cut by the action of the blade in shearing from the sheet a strip of the same width as the blade. The cutting edge preferably makes a constant angle with sheet at the point of shearing as it moves through the sheet.

16 Claims, 5 Drawing Figures

SHEET CUTTING MACHINE

FIELD OF THE INVENTION

This invention relates to machines for cutting sheet material, and is especially applicable to cutting relatively rigid fibrous board material, such as asbestos sheet.

BACKGROUND TO THE INVENTION AND PRIOR ART

Asbestos is a dangerous material with which to work when it is in a hard form such as a sheet. Most conventional cutting processes employ some such method as sawing or grinding by means of hardened discs, which give rise to unacceptable quantities of fibrous material in the air around the operator. In most countries official Regulations relating to asbestos cutting are very strict indeed, and require the use of respirators and air extractors before cutting is permitted.

SUMMARY OF THE INVENTION

The present invention provides a machine suitable for cutting asbestos sheet, but also applicable to cutting other materials such as rigid laminates, hardboard and the like.

According to the present invention there is provided a machine for cutting sheet material, comprising a frame including a support for the sheet, a cutting blade mounted to the frame, and operating means for advancing the blade through the supported sheet, the support having an elongate slot through which the blade passes after cutting through the sheet whereby the sheet is supported on each side of the slot during the cutting action, the edge of the blade which contacts the sheet having a substantially flat transverse profile so that the sheet is cut by the action of the blade in shearing from the sheet a strip of substantially the same width as the blade.

These and other advantageous features of the invention will be further described with reference to the accompanying drawings.

DETAILED DESCRIPTION

Figure 1:
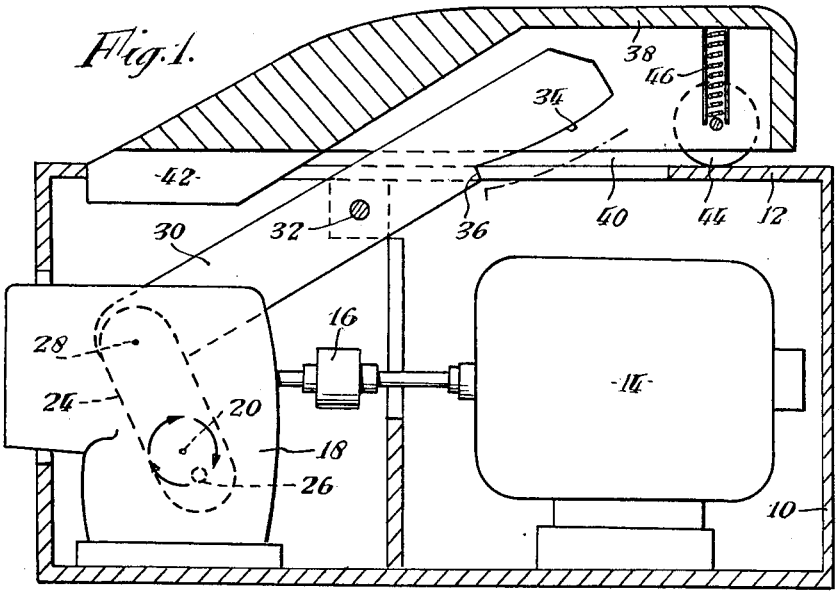
FIG. 1 shows a cross-sectional side view of the machine.
Figure 2:
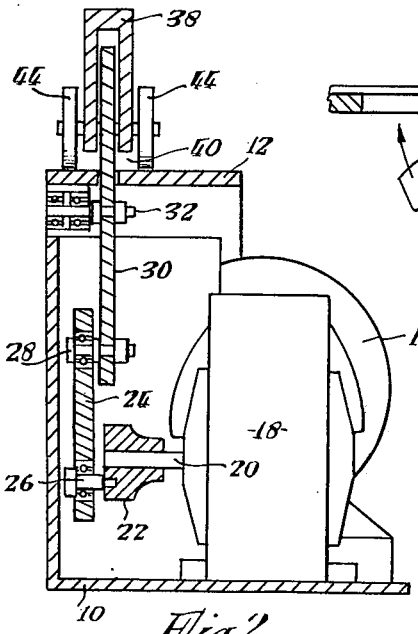
FIG. 2 shows a cross-sectional end view of the machine.

Referring to the drawings; the machine comprises a fixed frame 10 including a bed 12 to support the sheet material being cut in a horizontal plane. To the frame 10 is mounted an electric drive motor 14 linked through a coupling 16 to a single worm reduction gear box 18, whose output shaft is shown at 20. The output shaft 20 carries a boss 22 to which is eccentrically mounted a link arm 24 by means of a pivot pin 26. The other end of the link arm 24 is pivoted by means of pin 28 to one end of a cutting blade 30, which is in turn pivoted at 32 intermediate its ends to the frame, so that the free end of the cutting blade projects upwardly at an angle through a slot in the bed 12 in a vertical plane. The lower edge of the projecting end of the blade provides the cutting edge and its profile has a convex region 34 and a stepped region 36. A housing 38 shrouds most of the upwardly projecting end of the cutting blade, but allows a sufficient gap 40 for the insertion of the sheet material to be cut. The housing is mounted to the frame 10 through a spine portion 42 of the same thickness and in the same plane as the cutting blade, so as not to interfere with the cut sheet material. A pair of pressure wheels 44 are mounted to the housing and urged downwardly by a spring 46 so as to press on the upper surface of the sheet material as it is fed into the blade.

In action, the motor 14 via the gear box 18 drives the pivot pin 26 around a small circular path as indicated in FIG. 1, and this is transmitted via the link arm 22 as a reciprocatory movement to the lower end of the cutting blade which therefore describes an oscillatory movement about the pivot point 32. The blade is shown in FIG. 1 at the top of its stroke, and its position during cutting is shown in dot-dash lines.

Figure 4:
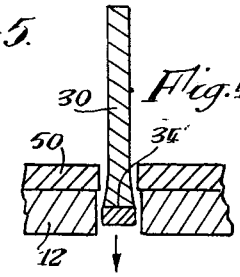
FIG. 4 shows an enlarged cross-sectional end view through the blade during cutting of the sheet.
Figure 3:
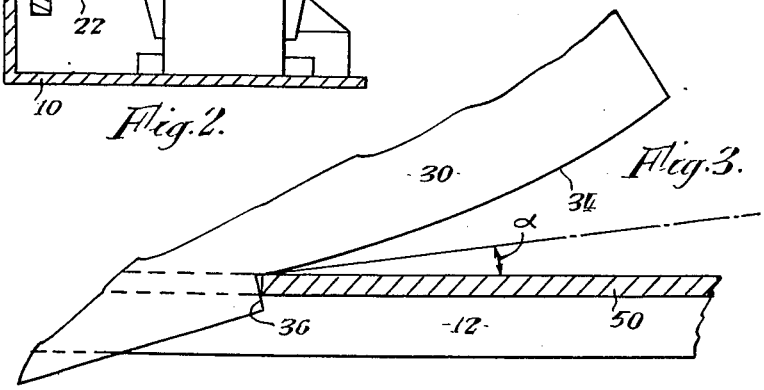
FIG. 3 shows an enlarged side view of part of the blade cutting the sheet.

FIG. 3 shows the blade as it is about to bear down on the sheet 50 being cut. The convex profile cutting edge 34 of the blade is ground flat in transverse section, as shown in FIG. 4, so that the pressure applied to the sheet imparts a shearing rather than a slicing action. The blade is hollow ground at the sides to facilitate its passage through the material for the remainder of the blade. The arcuate profile is designed so that the cutting edge at the point of cutting maintains the same angle a with the sheet through the cut. For example, when cutting asbestos it is preferred to select angle within the range 12° to 22°, most preferably an angle of 17° is used. For other materials, angles of between 10° to 25° are generally found optimum, depending upon the nature of the sheet being cut. Similarly, the width of the cutting edge of the blade may vary, but generally should be not less than one-eighth inch or greater than three-eighth inch, preferably not less than one-eighth inch or greater than one-fourth inch. For asbestos sheets a width of three-sixteenth inch is found most suitable. The shoulder 36 acts as an end stop for the sheet material, the sheet being stationary during each downward cutting stroke of the blade. At the end of each stroke the sheet is pushed forward so that the sheet at the end of the cut portion comes to rest on the shoulder of the blade before the next stroke begins. The preferred cutting rate will depend upon the nature and thickness of the sheet material, but will generally lie between 50 and 500 cuts per minute, and more particularly between 150 and 350 cuts per minute. A suitable cutting speed for asbestos sheet of up to ⅜ inch thickness is found to be 200 cuts/minute. Selection of a suitable blade speed ensures that the blade edge strikes the sheet with sufficient impact to effect a clean break in the material.

The length of cut which may be applied in one stroke can be quite substantial, up to 6 inches or even more. Generally, best results are obtained by designing the blade to give cuts not less than 1 inch or more than 6 inches in length, and for asbestos sheet in particular a length of cut of about 3 inches in found appropriate.

This particular configuration and arrangement of the cutting edge provides a clean cut with a minimum of breaking-away at the edge of the material. Also, for example in cutting asbestos, it produces a minimum of dust.

Figure 5:
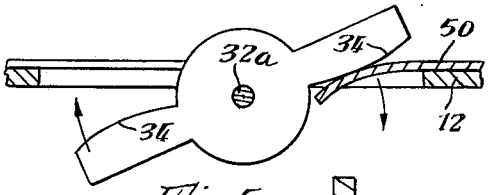
FIG. 5 shows diagrammatically a side view of a cutting blade arranged for continuous rotation rather than oscillation.

The motor could be mounted at any convenient position, instead of that shown, and the linkage between the motor and blade could be different from that shown. In one alternative form, as indicated in FIG. 5, the blade is continuously rotated (through motor and gear box) about a spindle 32*a* at its midpoint, the two ends of the blade being similar so that each in turn applies the cutting action as it comes round into contact with the sheet. In this case, the speed of rotation for asbestos sheet would suitably be 100 r.p.m. to give 200 cutting strokes/min. In another form, three or more blades can be formed round a central pivot, rather in the nature of spokes of a wheel, and the assembly rotated to provide a sequential cutting action at a suitable rate. In yet another form, the blade may be linearly instead of pivotally reciprocated. In that case, the working edge of the blade would preferably be straight instead of curved to maintain a constant cutting angle. As is evident from the figures, the cutting edge 34 of the blade 30 is elongated such that during the cutting stroke through the work piece 50, the cutting edge moves in a direction having a component transverse to said cutting edge.

Various additional improvements may be added to the cutting machine herein described and claimed, without departing from the invention. For example, an automatic feed device can be provided for the sheet material so that following each cut the sheet is pushed forward by known means and positioned ready for the next cut. Another variation provides for automatic collection and bagging of the waste cut sheet material, with or without the application of vacuum collection or any minor particles of duct. All such variations can be provided by means well known in the art.

Furthermore, by providing a bed support for the sheet material, wherein the bed support is suitably profiled to match the profile of the sheet materials, sheets other than flat sheets can be cut, for example corrugated sheets, and the like. In a further variation, the whole machine assembly in designed so that it may be readily transported to building sites and the like.

I claim:

1. An asbestos sheet cutting machine, comprising a frame including a bed over which the sheet can be advanced to a cutting zone, a cutting blade mounted to the frame at the cutting zone, and drive motor for continually advancing the blade through the sheet, the bed having an elongate slot at the cutting zone through which the blade passes after cutting through the sheet whereby the sheet is supported by the bed on each side of the slot during the cutting action, a housing arranged to receive the blade on its return stroke and spaced from the bed so as to provide a gap for insertion of the sheet material to be cut while limiting the extent to which the cut sheet can lift from the bed, and a roller mounted to the housing through resilient means urging said roller towards the bed, said roller being rotatable to allow the sheet to be advanced towards the blade, the edge of the blade which contacts the sheet having a substantially flat transverse profile of about 3/16 inch width and the sides of the blade adjacent the cutting edge being hollow ground, so that the sheet is cut by the action of the blade in shearing from the sheet a strip of substantially the same width as the blade, the blade being pivotally mounted to the frame and linked to said drive motor so as to be moved thereby with an oscillating motion about its pivot at a rate of about 200 strokes/minute, the longitudinal profile of the cutting edge of the blade being curved so as to maintain an angle of about 17° with the sheet at the point of shearing as it moves through the sheet.

2. A machine for cutting brittle sheet material comprising a frame including a support for the sheet, a cutting blade, mounting means for mounting the cutting blade to the frame, and a drive motor for continually moving the blade through the supported sheet in one direction on a cutting stroke and in the opposite direction on a return stroke, the support comprising a bed having an elongate slot through which the blade passes after cutting through the sheet whereby the sheet is supported on each side of the slot during the cutting action, and abutment means for engaging the other surface of the sheet whereby the sheet is supported in the region of the cut during the return stroke of the blade, the cutting edge of the blade which contacts the sheet having a substantially flat transverse profile which passes with close clearance through the slot in the bed, and the longitudinal profile of the blade cutting edge being elongated, said mounting means including means for mounting the blade to make an acute angle with the sheet during the cutting stroke and to move, during its cutting stroke, in a direction having a component transverse to said elongated cutting edge, so that the sheet is cut by the action of the blade in shearing from the sheet a strip of substantially the same width as the blade.

3. A sheet cutting machine according to claim 2 wherein the longitudinal profile of the cutting edge of the blade is shaped so as to make a substantially constant angle with the sheet at the point of shearing as it moves through the sheet.

4. A sheet cutting machine according to claim 3 wherein said angle is in the range 10° to 25°.

5. A machine according to claim 3 for cutting asbestos sheet wherein said angle is in the range 12° to 22°, the width of the cutting edge of the blade is in the range one-eighth to one-fourth inch, and the blade is arranged to be driven at a rate in the range 150 to 350 cuts/minute.

6. A sheet cutting machine according to claim 2 wherein the width of the cutting edge of the blade is from one-eighth to three-eighth inch.

7. A sheet cutting machine according to claim 2 wherein the sides of the blade adjacent the cutting edge are hollow ground.

8. A sheet cutting machine according to claim 2 wherein the blade is pivotally mounted to the frame and is linked to said drive motor so as to be moved thereby with an oscillating motion about its pivot.

9. A sheet cutting machine according to claim 2 wherein the blade is pivotally mounted to the frame about its mid-point and has a plurality of blade elements radiating therefrom, the blade being linked to said drive motor so as to be moved thereby in a continuous rotary motion, each blade element having a said cutting edge so as to effect an incremental cut in the sheet in passing therethrough, such that said cutting edge moves through the supported sheet in one direction on a cutting stroke during a first portion of the continuous rotary motion of said blade and said cutting edge continuously rotates back through the supported sheet in the opposite direction on a return stroke during a second portion of the continuous rotary motion of said blade.

10. A sheet cutting machine according to claim 2 wherein the blade is arranged to be driven at a rate of from 50 to 500 cuts/minute.

11. A sheet cutting machine according to claim 2 wherein the length of cut applied by one cutting stroke is from 1 to 6 inches.

12. A sheet cutting machine according to claim 11 wherein said length of cut is about 3 inches.

13. A sheet cutting machine according to claim 2 wherein the abutment means includes part of a housing arranged to receive the blade on its return stroke, and spaced from the bed so as to provide a gap for insertion of the sheet material to be cut while limiting the extent to which the cut sheet can lift from the bed.

14. A cutting machine according to claim 2 wherein the abutment means includes a pressure member arranged so as to be resiliently urged towards the bed in the region of the cut from the side of the sheet remote from the bed.

15. A sheet cutting machine according to claim 14 wherein the pressure member comprises a roller arranged so as to bear upon the surface of the sheet remote from the bed and rotatable to allow the sheet to be advanced towards the blade.

16. A method of cutting asbestos or the like brittle sheet material, which comprises supporting the sheet on a bed over an elongated slot in the bed, continually advancing a blade having an elongated cutting edge by means of a drive motor in a direction through the sheet and into the slot such that the cutting edge of the blade, during its cutting stroke, moves in a direction having a component transverse to said cutting edge, and supporting the sheet in the region of the cut on the side remote from the bed during the return movement of the blade through the cut, the edge of the blade which contacts the sheet having a substantially flat transverse profile and the width of the blade providing close clearance in passing through the slot, so that the action of the blade shears from the sheet a strip of substantially the same width as the blade.

* * * * *